United States Patent [19]
McKenney
[11] 4,445,023
[45] Apr. 24, 1984

[54] ELECTRIC THERMAL STORAGE HEATER SYSTEM FOR HEATING FLUIDS

[75] Inventor: James L. McKenney, Plymouth, Mass.

[73] Assignee: Vapor Corporation, Chicago, Ill.

[21] Appl. No.: 174,204

[22] Filed: Jul. 31, 1980

[51] Int. Cl.³ ..... H05B 3/00; F28C 3/06; F24H 7/04; F28D 7/06

[52] U.S. Cl. ..... 219/326; 165/34; 165/101; 165/154; 165/163; 165/164; 219/341; 219/378; 261/115; 261/158; 261/DIG. 10; 261/DIG. 32

[58] Field of Search ..... 219/325, 326, 378, 365, 219/341, 281; 165/163, 164, 154, 101, 34, 39; 261/158-161, DIG. 10, DIG. 32, 115

[56] References Cited

U.S. PATENT DOCUMENTS

| | | | |
|---|---|---|---|
| 347,228 | 8/1886 | Clarke et al. | 165/163 |
| 1,898,083 | 2/1933 | Duble | 165/34 X |
| 2,237,617 | 4/1941 | Trede | 165/163 |
| 3,422,248 | 1/1969 | Beaulieu et al. | 219/281 |
| 3,630,275 | 12/1971 | Beaulieu et al. | 165/154 |
| 4,143,642 | 3/1979 | Beaulieu | 126/437 |
| 4,243,871 | 1/1981 | McKenney | 219/326 |

*Primary Examiner*—Anthony Bartis
*Attorney, Agent, or Firm*—Francis J. Lidd

[57] ABSTRACT

A thermal storage heater system for heating fluids includes a storage tank for accumulating and storing energy in the form of a quantity liquid heated to a high temperature by an electric immersion heating element in the tank. A source of a first fluid to be heated is connected to the inlets of pilot and primary heat exchangers immersed in the high temperature liquid for transferring heat to the first fluid. A first circuit connects the outlet of the pilot heat exchanger to a point of use. A second fluid circuit connects the outlet of the primary heat exchanger to the point of use and includes a spring-loaded pressure sensitive check valve responsive to the flow rate in the first circuit for regulating the flow of fluid through the primary heat exchanger in response to a change in flow indicative of insufficient heating of the fluid by the pilot heat exchanger. The system includes an additional heat exchanger for heating a second fluid to be heated. The pilot, primary and additional heat exchangers each comprise at least one U-shaped tube immersed in the liquid with each tube having an inlet and an outlet aligned in a horizontal plane. A condenser is provided at the outlet of the pilot heat exchanger and additional heat exchanger for condensing any entrained steam in the heated fluid. The condenser for the additional heat exchanger includes a central spray tube connecting the source of second fluid to the inlet of the U-shaped tube, a concentric outer shell connecting the outlet of the U-shaped tube to the point of use, and a radially corrugated imperforate baffle therebetween.

12 Claims, 6 Drawing Figures

PRIMARY HEAT EXCHANGER 18
16
62
60
66
PRESSURE RESPONSIVE CHECK VALVE
68
64
PILOT HEAT EXCHANGER
CHECK VALVE
48
26
24
50
52
28
22
38
34
54
THERMOSTATIC MIXING VALVE
30
CONDENSER
46
56
36
44
32
20
42
40

90°
96
100
98
45°
102
100
82
90
84
100

ELECTRIC THERMAL STORAGE HEATER SYSTEM FOR HEATING FLUIDS

BACKGROUND OF THE INVENTION

A. Field of the Invention

The present invention relates to a new and improved system for heating fluids such as water and the like.

B. Description of the Prior Art

There are many prior art systems for heating establishments such as buildings and homes and for providing hot water for the use of the occupants of those buildings or homes. It is desirable in such situations to use energy such as electricity to heat the water during periods when electrical utilities generating equipment is operating below capacity, i.e. "off peak" periods. "Off Peak" operation reduces the cost of electrical energy and increases the efficiency of the system. Such systems typically include tanks within which a fluid such as water is contained. Water temperature is elevated through the use of electrical heating elements to store heat during off peak periods.

Once the temperature of the stored fluid is elevated to the desired level in these systems, working fluid such as water is thermally coupled to the storage tank, raising the temperature of the working fluid, either for heating the building or for hot tap water for the occupant. Examples of such systems are illustrated in U.S. Pat. Nos. 3,422,248, 3,630,275 and 4,143,642 incorporated by reference herein.

Prior art systems such as those listed above, however, include complex piping arrangements and multiple mixing valves. It is desirable to reduce the complexity of the piping system and the number of components while maintaining or increasing the efficiency of the system thereby reducing the cost and increasing the utility to the public.

Typical prior art systems employ heat exchangers for removing heat from the stored fluid to a circulating working fluid. The heat exchangers in the prior art include a plurality of U-shaped tubes mounted in an outer shell defining "tube side" and shell side passages internal of the exchanger. It has been discovered that if these tubes are placed in horizontal planes, only the lower tubes, depending on the flow rate, are required for heating. This horizontal arrangement greatly reduces the amount of steam that must be condensed from the tubes and maintains higher velocity in the tubes thus reducing the build up of materials in the upper tubes not in use at high storage temperatures.

In the past, typical prior art systems experienced difficulty with condensers under low system operating pressures. The difficulty resulted from too much steam being generated for the size of the condensing assembly. It was discovered that the same physical size prior art condenser was more effective if used in combination with horizontally arranged tubes in heat exchangers due to the reduced steam generated by these tubes.

In addition, typical prior art systems include back-up flow condenser units and it has been discovered that due to the reduced steam generated by horizontally arranged tubes, the back-up generated steam is routed to the main condenser and a back-up flow condenser is not required. It is desirable to eliminate the back-up flow condenser in order to eliminate the hammer that usually occurs in such condensers due to transient condensation.

SUMMARY OF THE INVENTION

An object of the present invention is to provide a new and improved system for heating fluid to be used to heat a building or to be used for consumption.

Another object of the present invention is to provide a thermal heating system requiring only a single mixing valve.

A further object of the present invention is to provide a new and improved thermal storage heating system that includes heat exchangers with a plurality of tubes aligned in parallel horizontal planes.

A still further object of the present invention is to provide a new and improved thermal storage heating system including a condenser with a new baffle therein to increase condensation of steam.

The present invention is directed to a new and improved thermal storage heater system that includes a storage tank for accumulating and storing energy in the form of high temperature liquid and a device for heating this liquid, such as electrical resistive elements. Immersed in the tank are pilot and primary heat exchangers and a heating coil.

A first fluid circuit is in fluid communication with the pilot heat exchanger and is connected to a source of fluid such as water to allow the circulation of the fluid through the heat exchanger thereby elevating the temperature of the water. From the pilot heat exchanger the water is circulated to a heat utilization device or a tap for heat consumption. The first fluid circuit is also connected to a mixing valve for mixing the heated water with the source water to adjust the temperature.

A second fluid circuit is in fluid communication with the primary heat exchanger and the mixing valve. A spring actuated check valve is positioned in the second fluid circuit and is sensitive to pressure drops such that the fluid through the second fluid circuit flows only if the temperature of the fluid in the first fluid circuit drops a predetermined amount.

The primary heat exchanger and the heating coil each include a plurality of tubes aligned in parallel horizontal planes. A third fluid circuit is in fluid communication with the heating coils and a utilization device and a fluid condenser is positioned in the third fluid circuit. The condenser includes a baffle for the condensation of steam during passage therethrough.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DETAILED DESCRIPTION OF A PREFERRED EMBODIMENT

Figure 1:
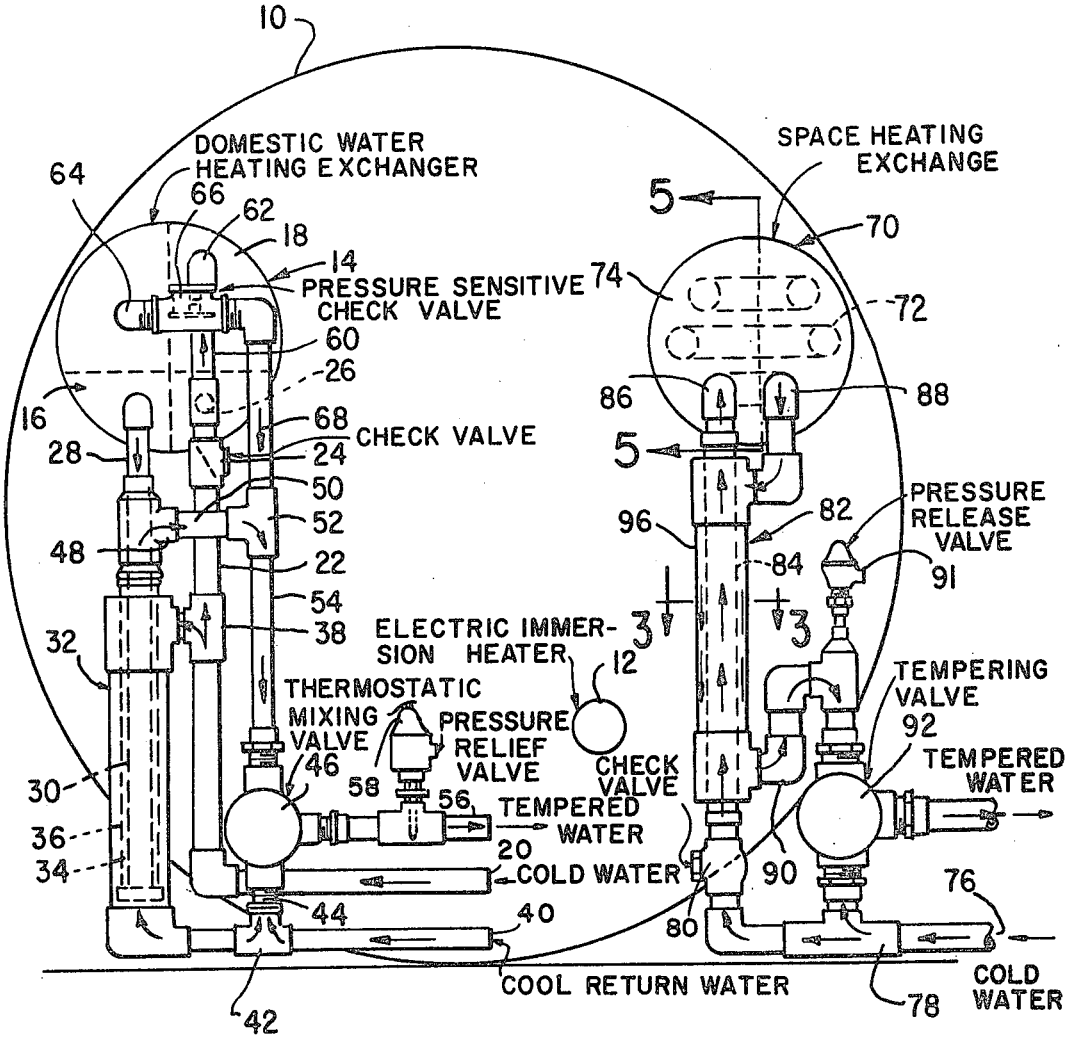
FIG. 1 is a view of a thermal storage heater system constructed in accordance with the principles of the present invention.
Figure 2:
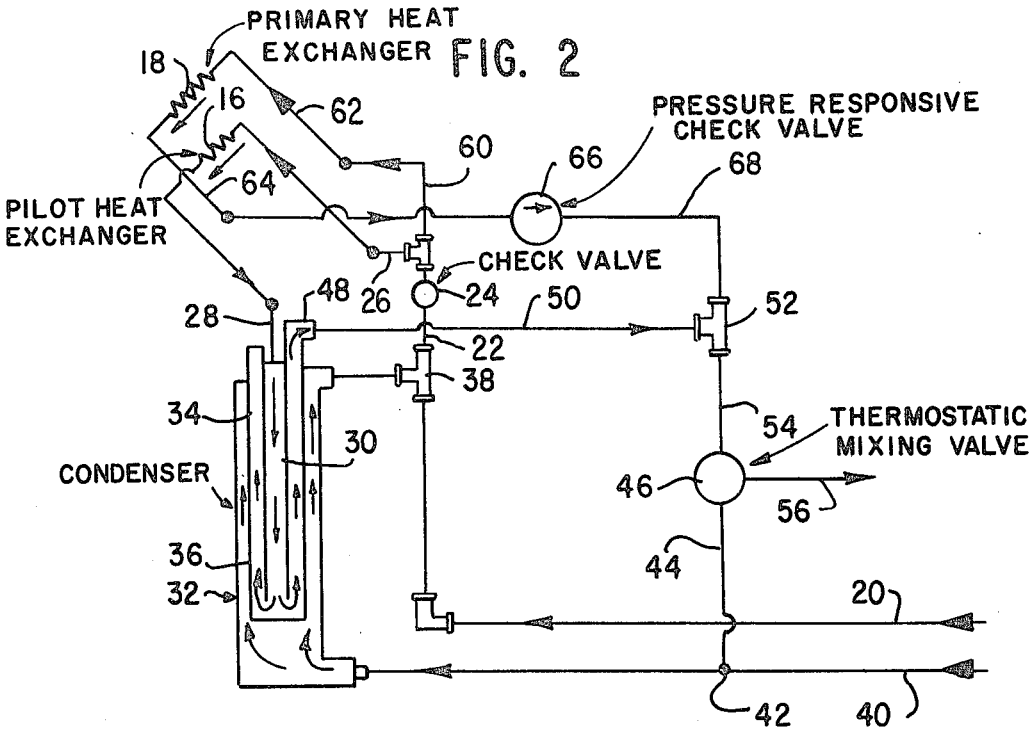
FIG. 2 is a schematic illustration of the system illustrated in FIG. 1

Referring to the drawings and intially to FIG. 1, a thermal storage heater system is illustrated that is an improvement of the system disclosed in U.S. Pat. No. 3,422,248 incorporated by reference herein. The system illustrated in FIG. 1 is intended for use in heating a dwelling and supplying hot water therefor. Particular configurations for each function will be discussed in detail. The system can be modified for use in commercial buildings by the completion of certain minor alterations that are not important for an understanding of the present invention. The system can also be employed to heat a variety of commercial or manufacturing structures and to supply hot water for commercial purposes. The specific temperature and pressure levels delineated hereinafter are those acceptable in the preferred embodiment of the invention except where the context otherwise admits. The specific parameters may be altered to accommodate specific operating conditions and are not intended to limit the invention disclosed hereinafter.

In the system of the present invention electric energy is utilized to heat water contained in a storage tank designated by reference numeral 10. The tank 10 is generally charged with treated water to a predetermined level and, as mentioned, is heated by means of immersion electrical elements 12 that, in the preferred embodiment illustrated, are located at the bottom of the tank 10. Water in the tank 10 may be heated, in the preferred embodiment, at a maximum of 280° F. at 50 p.s.i. Since the water in the tank 10 is in fluid isolation from the system, and used only for storage of heat, storage water becomes basically distilled and therefore inert, eliminating the requirement of a lined vessel. As the electrical elements 12 are immersed in this water, the build up of minerals from raw water is eliminated.

The water in the tank 10 is normally used to heat both domestic hot water and to heat water used to heat the house. Considering first that portion of the system employed to heat domestic hot water, this portion includes a combined heat withdrawal exchanger generally designated by the reference numeral 14 that includes a pilot heat withdrawal exchanger 16 and a primary heat withdrawal exchanger 18 connected in parallel across a cold water inlet 62 and a hot water outlet 64. Each of the heat withdrawal exchangers 16 and 18 includes a plurality of U-shaped tubes mounted in a header. The tubes are immersed in the tank 10. Although not shown, tubing bundles of heat exchangers 14, and 16 are identical to those disclosed in heat exchanger 70, and function in an identical manner to be discussed later. Cold water is introduced into the heat exchanger 16 from a cold water inlet 20. A portion of the cold water flows through tube 22 and through a one way flow check valve 24 into inlet 26 of the exchanger 16 through the tubes, and out an outlet 28.

The heated water and residue steam then passes into a spray tube 30 of a condenser 32. The heated water in the inner spray tube 30 flows into a spray chamber 34 defined between the inner spray tube 30 and an outer shell 36. The residue steam in the heated water is condensed by the flow of cool return water around the shell 36 that is introduced into the condenser 32 from the T-connection 38 from cold water inlet 20 and from the cool water return inlet 40 and T-connection 42.

The cooler circulating water is returned through the return tube 40. A portion of the returning cool fluid, however, passes through a T-coupling 42 into a tube 44 to a thermostatically controlled mixing or tempering valve 46.

In addition, high temperature fluid flows from the concentric condensing chamber 34 through an outlet 48 to a tube 50 and a T-coupling 52 whereupon it passes through a tube 54 to the mixing valve 46. The thermostatically controlled mixing valve 46 mixes the heated water from the tube 54 with the cool water from the return conduit 44 and directs the mixed water through the outlet tube 56 to a utilization device such as a hot water tap. A pressure relief valve 58 is coupled to the outlet conduit 56 to function as a safety device.

The pilot heat withdrawal exchanger 16 provides sufficient hot water when demand is low and/or the temperature of the fluid in the tank 10 is high. If the demand for and/or flow of hot water is high and/or the temperature of the fluid in the tank 10 is low, however, supplemental hot water is required. Supplemental hot water is provided by the primary heat withdrawal exchanger 18. The primary heat withdrawal exchanger 18 is similar in construction to the pilot heat exchanger 16 in that it includes a bundle of U-shaped tubes immersed in the tank 10 utilizing the construction of exchanger 70 to be discussed later. One difference, however, is that the tubes may be greater in number and larger in diameter.

Cold water from the source conduit 20 is introduced to the primary heat withdrawal exchanger 18 through conduit 60 to inlet 62. The cold water passes through the bundle of tubes of the primary heat withdrawal exchanger 18 and flows to the outlet conduit 64. A spring loaded check valve 66 is in fluid communication with the outlet conduit 64 and controls the flow of heated fluid to an outlet conduit 68 in fluid communication with the T-coupling 52.

The spring loaded check valve 66 is sensitive to pressure drop. For example, if the temperature of the water flowing from the pilot heat exchanger 16 drops below a predetermined level, the tempering or mixing valve 46 allows an increased flow from conduit 54 to meet the required temperature at the utilization device. As this flow increases, there is a pressure drop at point 52 which upon reaching a predetermined level, actuates the valve 66. As another example, if there is a large increase in demand, flow from the pilot heat exchanger 16 is increased thereby decreasing the pressure at point 52 and actuating the valve 66.

Under either of the above conditions, the spring loaded check valve 66 senses the decreased pressure at point 52 and opens a sufficient amount to allow additional flow through the primary exchanger 18 to be mixed with the flow from the pilot heat exchanger 16.

The spring actuated check valve 66 in the system of the present invention allows utilization of only a single mixing valve 46, while providing demand apportioned flow through heat exchangers 14 and 16, thereby eliminating a second mixing valve and related hardware found in prior art systems. The elimination of a second mixing valve increases the reliability of the system and reduces overall costs.

Figure 5:
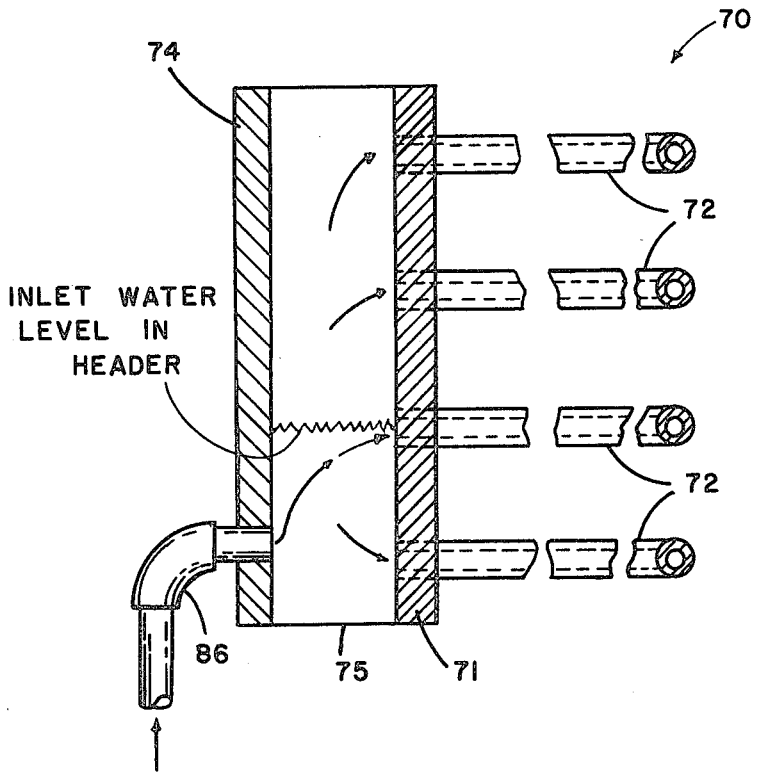
FIG. 5 in a cross-sectional view taken along line 5—5 of FIG. 1, wherein line 5—5 is somewhat displaced from the center line of the heat exchanger.
Figure 6:
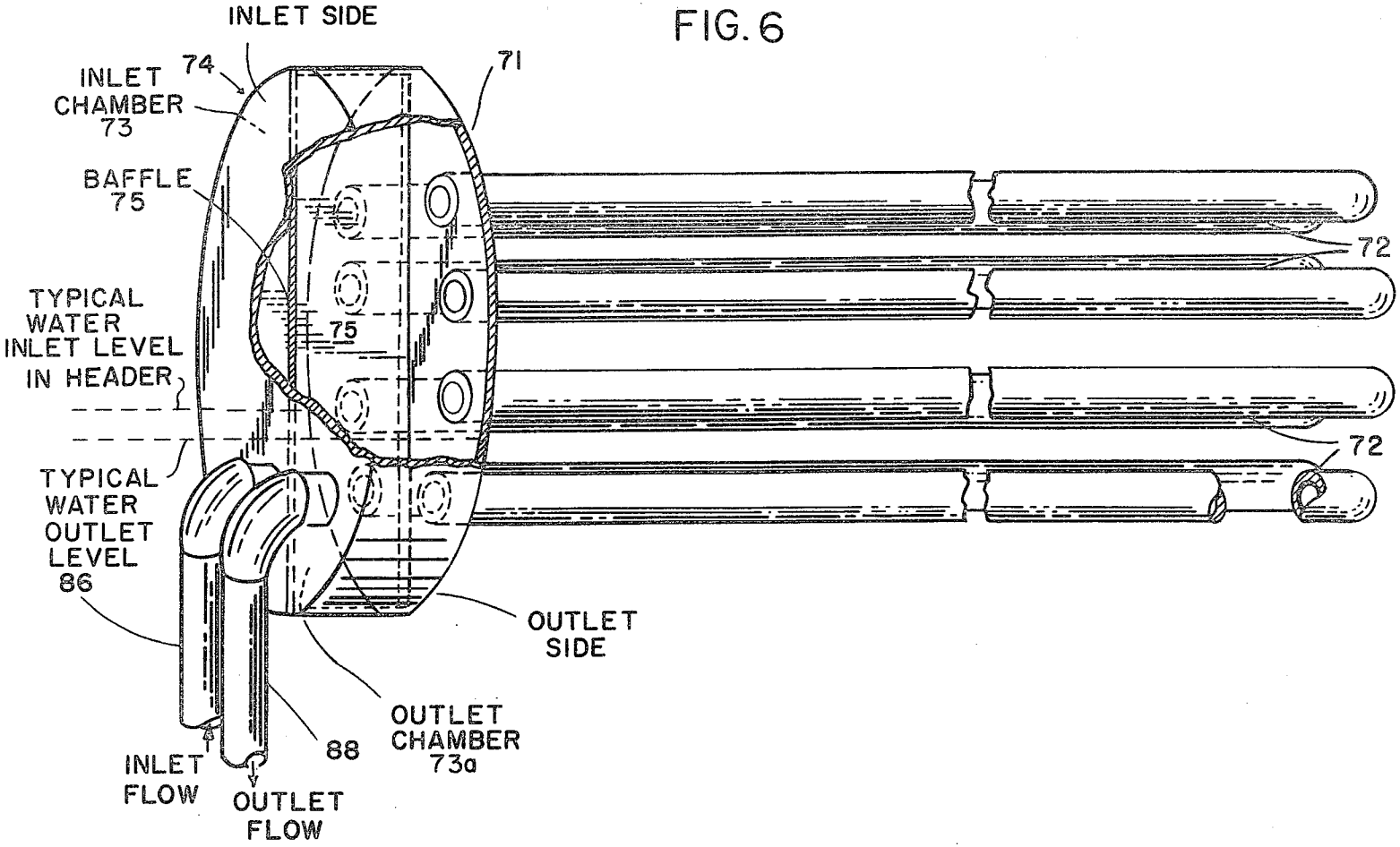
FIG. 6 is a partially cut-away, perspective view of a heat exchanger and coil used in the storage heater sustem of the present invention.

The system of the present invention also includes a heating coil generally designated by the reference numeral 70 that is employed to heat water that may be circulated through a building such as a home to heat that building. The heating coil 70 includes a bundle of U-shaped tubes 72 (FIG. 5) aligned in parallel and horizontal planes in fluid communication with header chambers 73 and 73*a*. Inner header 71, outer header 74, and vertical partition 75 essentially define header inlet and outlet chambers or portions 73 and 73*a*, respectively (ref. FIG. 6). As shown, inlet and outlet water levels cover inlet 86 and outlet 88, avoiding entrained steam in delivered hot water. The tubes 72 are immersed in the tank 10 such that the water contained in the tank 10 elevates the temperature of fluid circulating through the tubes 72. The tubes in prior art heat exchangers were positioned in vertical planes utilizing a horizontal baffle header. It has been discovered, however, that if these tubes are placed in parallel horizontal planes, in conjunction with a vertical header baffle, only the lower tubes during heat withdrawal involving steam generation are utilized to provide the heating required dependent on the flow rate.

It has been discovered that a horizontal arrangement greatly reduces the amount of residue steam formed in the individual heat exchange tubes that must be condensed.

Horizontal orientation of the heat exchanger U-bend provides improved individual U-tube flow regimes since inlet and outlet are at essentially the same height. It has been found that, as opposed to a heat exchanger construction, utilizing U-bends where the inlet and outlet are displaced, i.e., the outlet is above the inlet, the disclosed construction results in process water having substantially less entrained steam at submerged outlets and therefore of substantially higher quality since steam rises to the upper portion of the header 74 and heated water only flows from the bottom of the header 74 through the outlet 88, only water as opposed to water and steam passes through the outlet. The improved heated water outlet quality results in greatly reduced steaming in the exit portion of the heat exchange header. This is a substantial advantage since accumulation of any substantial amount of steam in the exit header must be condensed in the outlet condenser 82, resulting in increased condensing load and/or possibly requiring a larger external condenser. An additional advantage provided by the horizontal U-bend, vertical baffled construction, involves reduced mineral formation in the U-bends, provided by the improved steam quality in the horizontal tube configuration.

Also, higher velocity is maintained in the tubes 72 that are in use whereby the build up of minerals in the upper tubes not in use is reduced. Prior art systems with vertically aligned tubes also experience difficulty in the condensers during low system operating pressures. As discussed above, during this mode of operation, too much steam is generated for the size of the condensing assemblies. It has been discovered, therefore, that by using the horizontally aligned tubes in the same size prior art immersed exchangers of the type shown and identified as elements 14, 16, and 70, the flow of heated water through tubes having submerged inlets and outlets increases overall flow through the exchanger, due to the reduced amount of steam entrained in the heated system or service water, resulting in reduced pressure drop and increased water delivery. Consequently a variation in the heat exchanger configuration has produced substantial improvements in overall system performance.

As indicated above, the horizontal bend/vertical baffle construction has been found to be useful in both single and multiple baffle heat exchangers exemplified by elements 70, and 14 and 16 respectively.

Returning to the heat exchanger 70 of the present invention, the tubes 72 are supplied with cold source fluid or water from an inlet 76 through a T-coupler 78 and a one-way check valve 80 to a condenser 82. The cold fluid passes through a central spray tube 84 of the condenser 82 to an inlet conduit 86 that is in fluid communication with the inlet side of the header or chamber 73. The cold fluid then passes through the horizontally aligned heat exchange tubes 72 returning to the opposite side of the partitioned header or chamber 73*a* and to the outlet conduit 88, whereupon the heated fluid with residue steam is returned to the condenser 82 through the annular passage between shell 96 and tube 84. The steam in the hot water is condensed due to water spray from the cold fluid passing through the spray tube 84 of condenser 82 whereupon the heated fluid exits through an outlet conduit 90 and introduced to a thermostatically controlled mixing or tempering valve 92. A relief valve 91 is mounted in the conduit 90 to release high pressure if necessary.

Cold source water from the inlet 76 is also introduced into the tempering or mixing valve 92 by the T-connector 78. The hot water from heat exchanger 70 is mixed with the cold water from the cold water source 76 in the mixing valve 92 to the preferred temperature and passed through the outlet conduit 94 to a heat utilization device such as the radiator located in the home.

Figure 3:
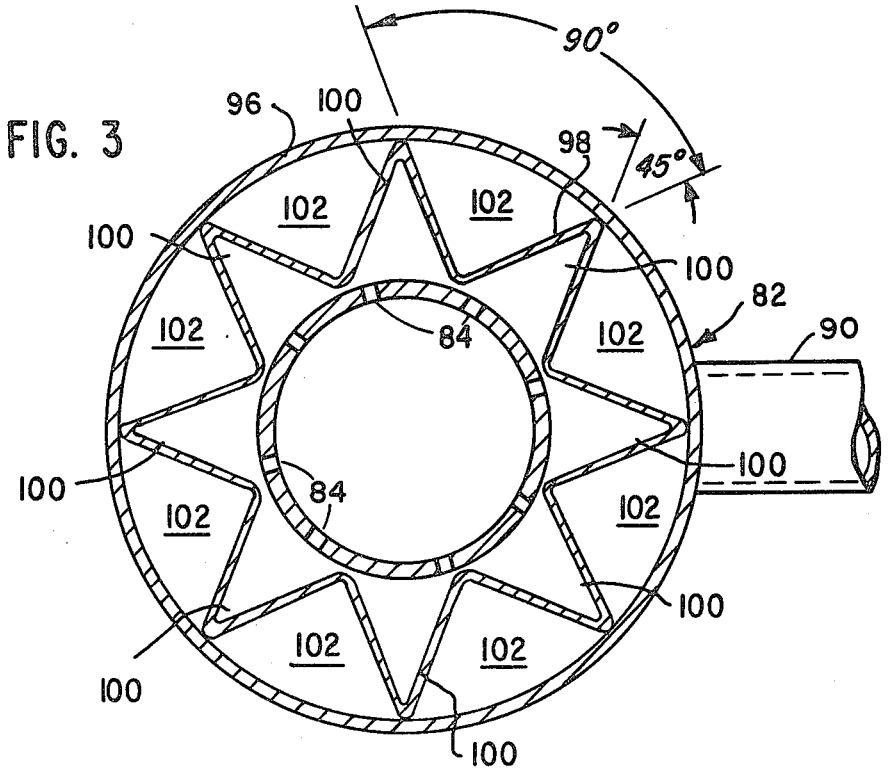
FIG. 3 is a sectional view along line 3—3 of FIG. 1, showing a condenser and baffle employed in the system of the present invention.
Figure 4:
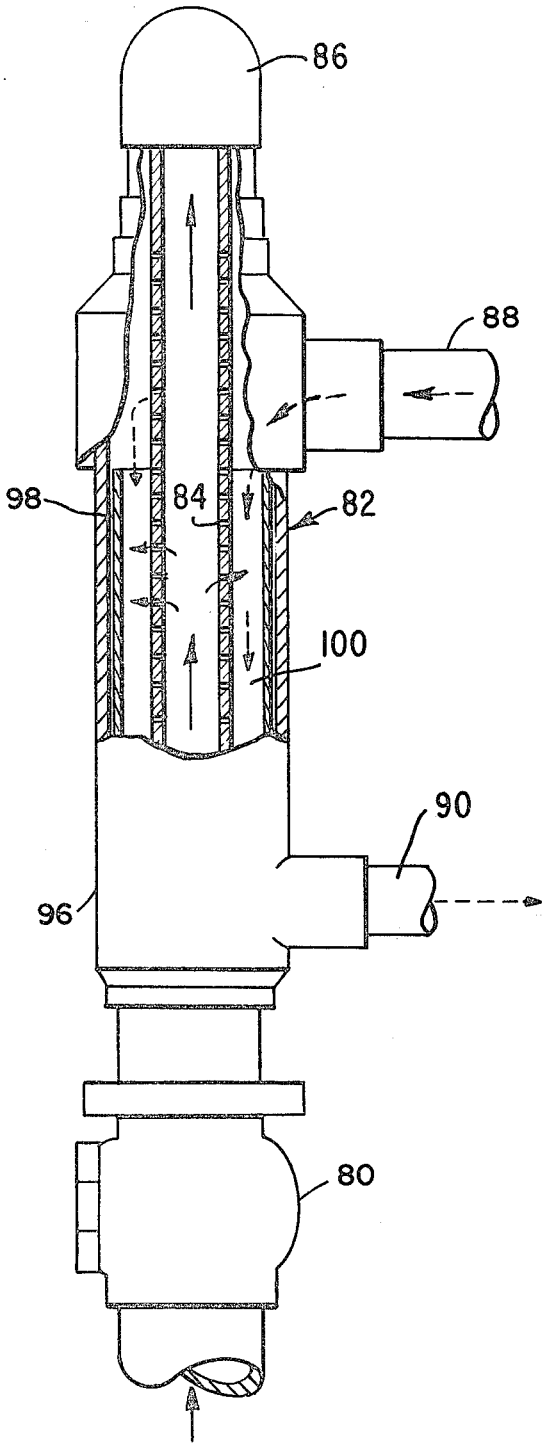
FIG. 4 is a view of the condenser in partial section showing internal construction and condensing zones.

As illustrated in FIGS. 3 & 4, the condenser 82 is of a novel construction. More specifically, the condenser 82 includes an outer shell 96 surrounding and concentric with the cold water inlet tube 84. Within the space defined between the inner peripheral surface of the shell 96 and the outer peripheral surface of the cold water inlet spray tube 84 a baffle 98 is positioned. The inlet spray tube 84 is perforated in a manner to provide radial flow of a substantial amount of the cold water return exiting from check valve 80. The radial cool water spray enters the chambers 100 defined by the baffle 98 positioned between the spray tube 84 and the outer shell 96. The baffle 98 is radially corrugated in the preferred embodiment illustrated, however, many different shapes may be employed as preferred and consistent with the principles of the present invention.

The baffle 98 greatly increases the condensing action of the condenser 82 in that it provides continuous condensation within the space within which the baffle 98 is positioned. More specifically, the mixture of steam and water exiting the heat coil 70 and entering the condenser 82 by way of conduit 88 in part enters the triangular spaces 100 defined between the baffle 98 and the cold water inlet spray tube 84. In addition, a portion of the mixture of steam and water also enters the triangular spaces 102 defined between the baffle 98 and the inner peripheral surface of the shell 96. Due to the proximity of the mixture of steam and water carried in the spaces 100 to the cold water inlet tube 84, condensation of steam in the spaces 100 proceeds rapidly and due to the confining nature of the corregations of the baffle 98, in a progressive manner from the top or inlet of the condenser 82 to the outlet or lower end of the condenser 82. The mixture of steam and water entering the spaces 102, moreover, generally includes larger pockets of steam or water vapor and condenses slower; however, again the confining nature of the corrugations of the baffle 98 impose a progressive condensing action.

This progressive action produced by the addition of the baffle 98 within the space illustrated is highly beneficial in that it prevents transient condensation and the type of "hammer" usually encountered in prior art steam condensers. A further advantage of the baffle 98 is that the longitudinal pressure drop while little or no condensation takes place is greatly reduced in comparison to the prior art condensers. As one skilled in the art will recognize, although the condenser 82 and pressure sensitive check valve 66 are illustrated as co-existing in the same system 10, each may be employed in separate systems.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. A thermal storage heater system for heating fluid to be used for heating and consumption comprising:

means for storing a quantity of liquid capable of being heated to a high temperature;

means for heating the stored liquid to a high temperature to store heat in the stored liquid;

first and second heat exchange means in said storing means for transferring heat from said high temperature liquid to a fluid to be heated, each said heat exchange means including an inlet and outlet, a source of fluid to be heated in communication with said inlets and a point of use in communication with said outlets;

a first fluid circuit in fluid communication with the outlet of said first heat exchange means for supplying heated fluid to said point of use;

a second fluid circuit in fluid communication with the outlet of said second heat exchange means for supplying heated fluid to said point of use; and pressure sensitive valve means located in said second fluid circuit responsive to first fluid circuit pressure for regulating the flow of said fluid through said second fluid circuit and second heat exchange means in response to a change in pressure indicative of insufficient heating of the fluid by the first heat exchange means.

2. The system claimed in claim 1 further comprising a thermostatic fluid mixing valve with a first inlet in fluid communication with outlets of said first and second fluid circuits, a second inlet communicating with said source of fluid, and an outlet in fluid communication with said point of use.

3. The system claimed in claim 1 wherein said first heat exchange means comprises a pilot heat exchanger and said second heat exchange means comprises a primary heat exchanger of larger heat exchange capacity than said pilot heat exchanger.

4. The system claimed in claim 1 further comprising a fluid condenser in fluid communication with the outlet of said first heat exchange means for condensing steam in said heated fluid.

5. The system claimed in claim 1 wherein said pressure sensitive valve means comprises a spring loaded check valve.

6. The system claimed in claim 1 wherein said second heat exchange means comprises a primary heat exchanger including a plurality of U-shaped tubes each with an inlet and an outlet aligned in parallel horizontal planes.

7. The system claimed in claim 1 further including a heating coil with an inlet in communication with a source of second fluid to be heated and an outlet in communication with a point of use, said coil comprising a plurality of tubes each including an inlet in communication with said inlet of said coil and an inlet in communication with said outlet of said coil, aligned in parallel horizontal planes.

8. The system claimed in claim 7 further comprising a condenser in fluid communication with the outlet of said heating coil for condensing steam in said second heated fluid.

9. The system claimed in claim 8 wherein said condenser includes a perforated central tube, an outer concentric shell, and a radial corrugated sheet interposed between said tube and said shell, said tube including a first end in communication with a source of second fluid to be heated and a second end in communication with the inlet of said heating coil, the outlet of said shell including a first end in communication with said heating coil and a second end in communication with a point of use, spaces between said shell and said sheet being in communication with spaces between said tube and said sheet.

10. A thermal storage heater system comprising:

means for storing a high temperature fluid, including means for heating the stored fluid to a high temperature, thereby storing heat in the fluid;

first heat exchange means for heating a fluid to be heated mounted in said storing means in heat exchange relationship with the high temperature fluid stored therein, said first heat exchange means including at least one tube with an inlet and an outlet aligned in a horizontal plane, and a first fluid circuit in fluid communication with the inlet of said first heat exchange means and a source of a first fluid to be heated coupled to said first fluid circuit, a heating coil in said storing means in heat exchange relationship with the high temperature fluid therein, a second fluid circuit in fluid communication with the inlet of said heating coil for circulating a second fluid to be heated therein, and a condenser in communication with said second fluid circuit, said condenser comprises a spray tube communicating at a first end with said source of second fluid and at a second end with the inlet of said heating coil, an outer shell concentric of said spray tube and an imperforate baffle interposed between said tube and said shell, said shell communicating at one end with the outlet of said heating coil, and at its other end with said second fluid circuit.

11. In a thermal storage heater system for heating fluid including means for storing a liquid capable of being heated to a high temperature, means for heating the stored liquid to a high temperature, heat exchange means in said storing means for transfering heat from the high temperature liquid to a fluid to be heated, fluid circuit means for communicating said heat exchange means with a source of fluid to be heated and a fluid utilization device coupled to said fluid circuit means, the improvement comprising;

a condenser in said fluid circuit means, said condenser condensing steam from said heated fluid on exiting said heat exchange means and comprising an outer shell for containing heated circuit fluid flowing from said heat exchange means to said utilization device, an inner spray tube mounted in said shell for distributing fluid from said source of fluid, internally of said shell and to said heat exchange means, and a baffle mounted in said shell between said shell and said tube, wherein steam generated by said heated fluid on entering said shell is condensed by said source fluid to be heated, providing continuous flow to said utilization device.

12. The system claim in claim 11 wherein said baffle is radiallycorrugated.

* * * * *